United States Patent [19]

Jacoby

[11] 4,085,971

[45] Apr. 25, 1978

[54] ENERGY CONSERVING MINING SYSTEM AND METHOD

[75] Inventor: Charles H. Jacoby, Dalton, Pa.

[73] Assignee: Occidental Minerals Corporation, Lakewood, Colo.

[21] Appl. No.: 742,632

[22] Filed: Nov. 17, 1976

[51] Int. Cl.[2] ..... E21C 41/14

[52] U.S. Cl. ..... 299/4; 166/266; 166/267

[58] Field of Search ..... 299/4, 5, 2, 6; 166/267, 268, 269, 266, 68.5, 314, 105.5, 105.6; 60/641

[56] References Cited

U.S. PATENT DOCUMENTS

| | | | |
|---|---|---|---|
| 245,101 | 8/1881 | Thayer et al. | 166/68.5 |
| 1,572,333 | 2/1926 | Taylor | 166/105.6 |
| 2,030,159 | 2/1936 | Scott | 166/105.6 |
| 2,772,868 | 12/1956 | Brandt | 299/5 |
| 3,442,332 | 5/1969 | Keith | 166/267 UX |
| 3,887,008 | 6/1975 | Canfield | 166/267 |
| 3,915,499 | 10/1975 | Mallon | 299/4 |
| 4,014,575 | 5/1977 | French et al. | 166/267 |

*Primary Examiner*—Ernest R. Purser
*Assistant Examiner*—William F. Pate, III
*Attorney, Agent, or Firm*—Bean, Kauffman & Bean

[57] ABSTRACT

There is disclosed an improved system method for in situ extraction of mineral values from subterranean deposits of ores of the oxide; carbonate; sulphide, or other type ores which contain sought-for metal values and which evolve gas when reacted with suitable chemicals in solution and/or gaseous form. The invention is particularly applicable to in situ mining of the previously found types of copper, nickel, manganese, etc. oxide, carbonate, and sulphide ores and the like; and especially features conservation of energy which otherwise would be wasted.

35 Claims, 4 Drawing Figures

ENERGY CONSERVING MINING SYSTEM AND METHOD

BACKGROUND AND SUMMARY OF THE INVENTION

Figure 1:
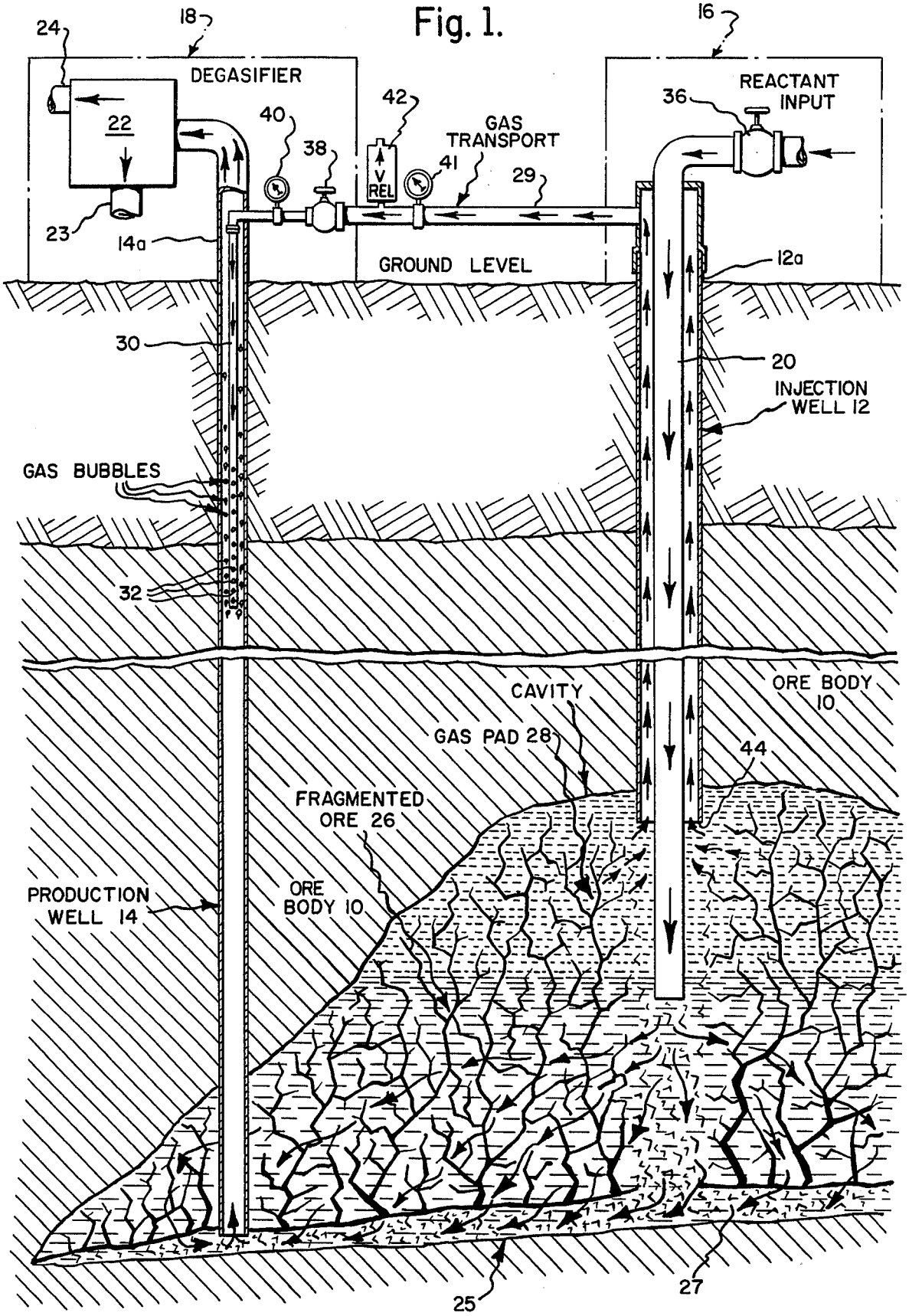

In accordance with previously proposed chemical mining systems a geologic formation containing an ore body is first penetrated by one or more suitably spaced-apart bore holes extending from the earth's surface. An ore body fragmenting explosive or the like is then usually required so as to induce permeability of the ore body so as to permit travel of fluid therethrough; and a suitable chemical solution or gas is then caused to circulate from an input well(s) through the fragmented ore body of the production outlet tubing.

The present invention features provision of means for profitably employing the gases which evolve under pressure within the ore body incidental to the reaction-/extraction process, to maintain the roof of the mining "cavity" and to raise (or assist in raising) to the surface-located treating plant the valuable mineral products of the underground reaction process, in improved manner. As an incident thereto progression of the reactive chemical material throughout the fragmented ore body as well as travel of the solute products of the reaction process to the product outlet is facilitated. Hence, a previously wasted source of energy evolving from the mining operation per se is conserved. It is therefore an object of the present invention to provide an improved in situ mining method and system.

Prior patents known to be relevant to mining techniques referred to herein include for example U.S. Pat. Nos. 2,954,217; 3,278,232; 3,278,233; 3,640,579; 753,045; 2,828,819; 2,362,442; 2,875,833; 3,289,609; 3,822,916 and 3,829,245.

THE DRAWING

Figure 2:
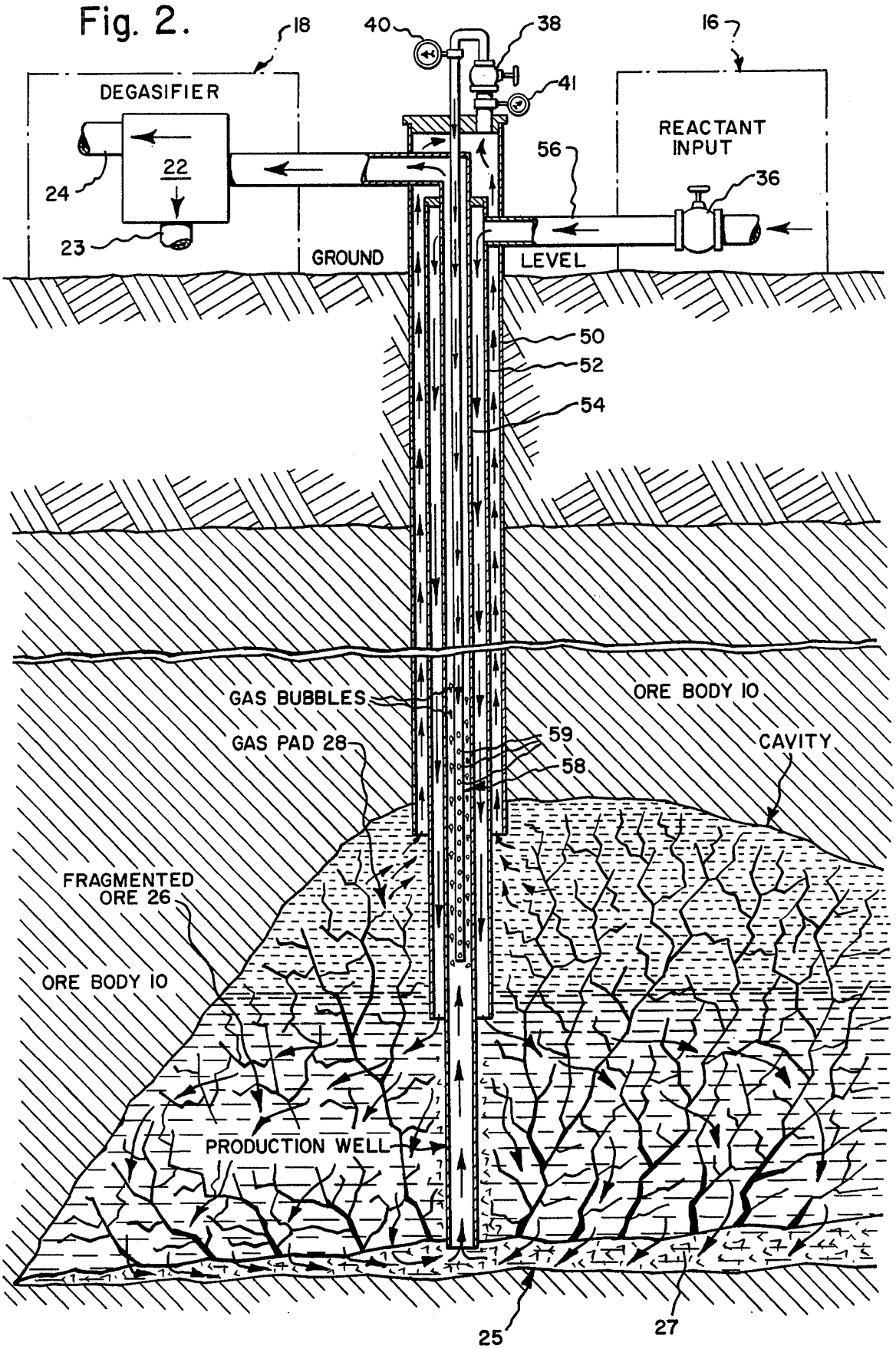

FIG. 1 is a symbolic vertical geological cross-section, showing diagrammatically how a typical subterranean ore body may be mined in situ by a multi bore-hole chemical reaction and mineral value recovering system, in accordance with the present invention;

FIG. 2 corresponds to FIG. 1 but illustrates the method of the invention when employed in conjunction with a single bore-hole system.

Figure 3:
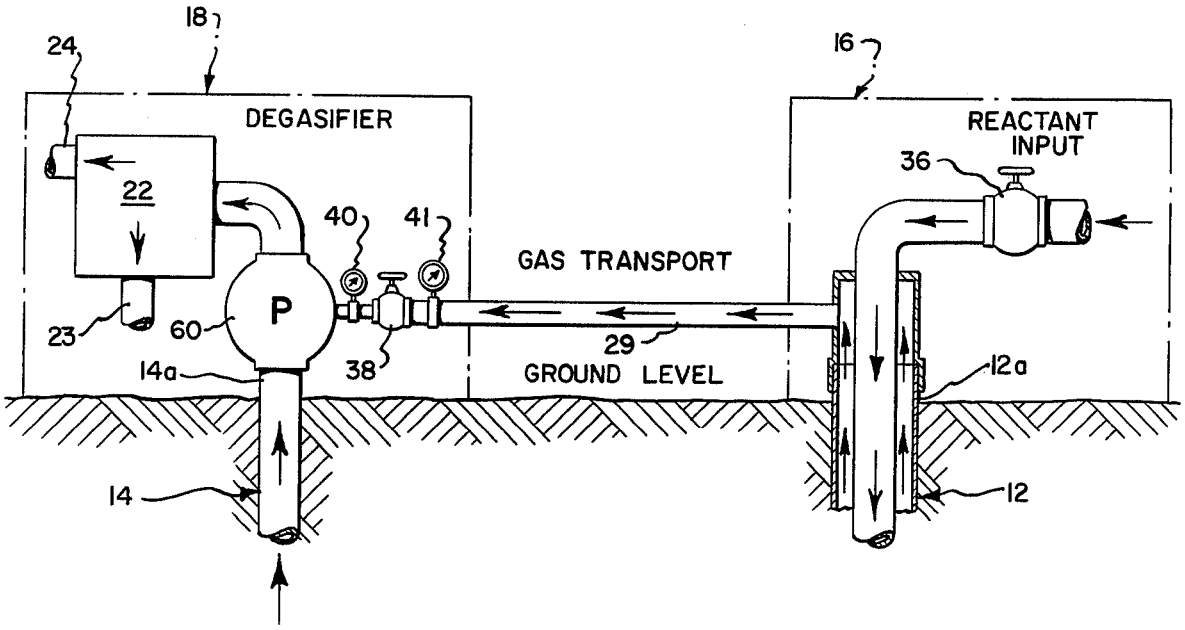
Figure 4:
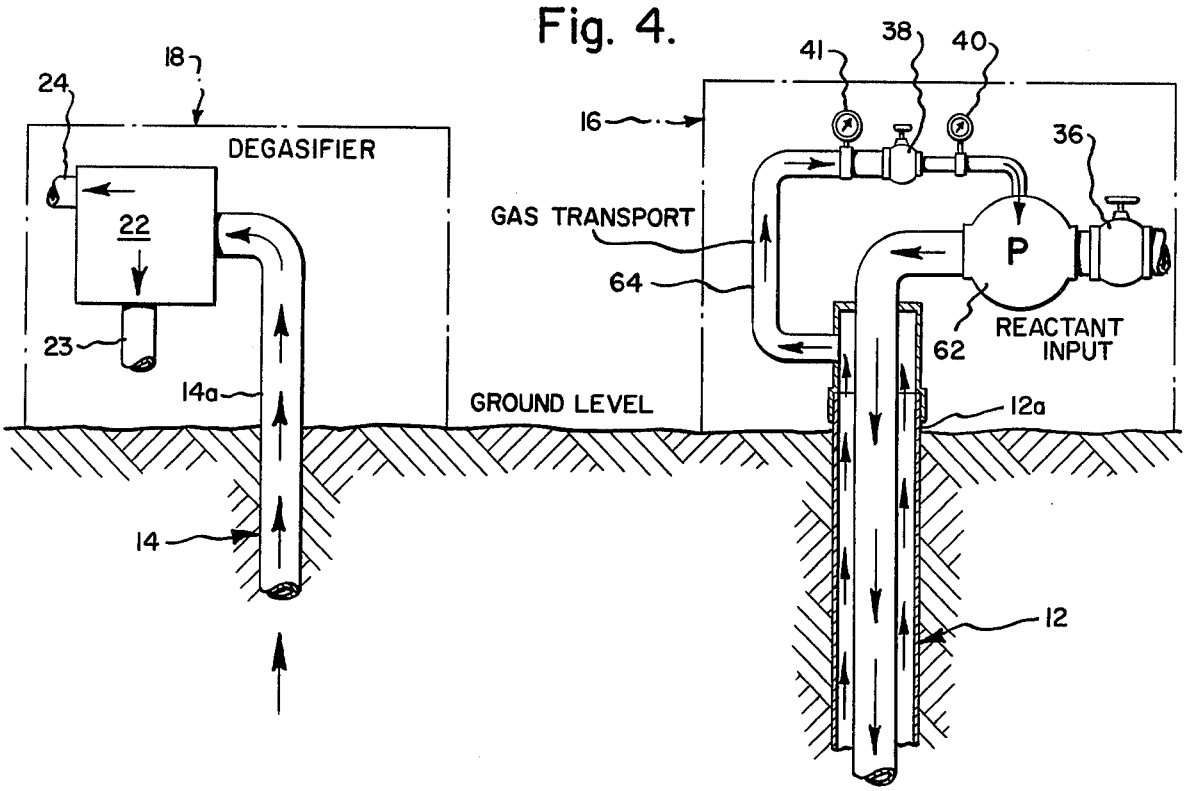

FIGS. 3 and 4 are schematic views of modified forms of evolved gas utilization systems.

SPECIFICATION

As illustrated by way of example at FIG. 1 in the drawing herewith, the method of the invention may be applied to an ore deposit such as is designated generally at 10; which is intersected by a pair of drilled "wells" or bore holes 12, 14, which communicate at their upper ends with surface-located facilities such as are indicated generally at 16, 18. The bore holes are lined by means of casings **12*a*, 14*a* fabricated of (or lined with) materials which are non-reactive relative to the materials being handled. The casings 12*a*, 14*a* are preferably sealed or "packed" relative to the bore holes 12, 14 by any suitable cementing or other "packing" technique, so as to shut off the ore from the surface, thereby forming a pressurizable chamber of the cavity contained ore body 10. As shown the input bore hole is double-cased to include an inner tube 20 through which the reactant input is delivered into the ore body from the surface plant 16 such as under control of a valve 36; while the production well 14 delivers to the surface plant 18 the sought-for products of the reaction process. The plant 18 will typically include a degasifier (or separator) as is shown at 22, having a solution "product" outlet 23 and a gas "product" outlet 24. The gas outlet 24** will preferably connect to means (not shown) for pneumatic by-product recovery purposes.

The invention features provision of means for employing the otherwise wasted gas pressure evolving within the ore body (while the sought-for mineral reaction/extraction process is underway) to raise the sought-for mineral products of the reaction process to the surface treating plant 18 while at the same time supporting the roof of the mining "cavity" in an improved manner. The evolved gas pressure is utilized to raise the mineral "product" through the production well, preferably "directly" as by means of an "air-lift" type pumping operation, which may be either self-sufficient for the product raising operation or employed to energize a supplementary pumping operation via use of a pneumatic type motor coupled to a mechanical pump arranged in conjunction with the production well. However, any such pumping equipment must be adequately engineered to insure its continued operating efficiency; and depending upon the nature of the liquid "product" this may be impractical from the economic/-technological standpoint. Therefore, use of the "air-lift" pumping principle is preferred. In any case the gas pressures evolved incidental to the ongoing underground chemical reactions furnish energy for raising to the surface the sought-for liquid "products" thereof; and as incidents thereto these pressures are employed to maintain the roof of the mining "cavity" and to assist travel of the reactive/product fluids through the fragmented ore body, by reducing "back pressure" forces thereagainst.

To prepare the ore body for in situ mining in accordance with the method of the present invention, any desired number of bore holes may be employed. As shown by way of example in FIG. 1 herewith, either or both of the bore holes 12, 14, may be used through which to initiate an underground ore body fragmentation operation such as by means of an explosive. The ore body fragmentation operation may be facilitated by first propogating a "hydraulic fracture" through the ore body between the lower levels of the bore holes to provide a "base cavity" such as is illustrated at 25. Such fracturing operation may be performed in accordance with any suitable hydraulic fracturing/propping technique to provide a fluid-permeable region extending radially from the bottom of the input bore hole(s) to interconnect with the bottom of the production well(s).

When operating for example in the case of a copper oxide or carbonate type ore, the "hydro-frac" operation is preferably performed by using a water-diluted sulfuric acid solution containing in suspension a fracture "propping" agent such as sand, glass beads, or the like; as is well known in the art. The passageway 25 so produced between the lower ends of the bore holes may then be utilized for introduction of a liquid or slurry type explosive which may be subsequently detonated so as to fracture the ore body thereabove into a fragmented fluid-permeable mass, such as is illustrated at 26.

The mining process is then conducted by passing a liquid or gas which is chemically reactive with the sought-for mineral, throughout the fractured ore system so as to extract therefrom the desired mineral values. The chemical content of the reactant fluid will of course be prescribed and adjusted according to the nature of the sought-for mineral values. Specifically, the chemical content of the selected reactant will be of such nature as to break down and chemically recombine with the sought-for mineralization of the ore body so as to produce a readily soluble salt(s) of the mineral(s); which salt(s) solution then finds its way through the fragmented ore body to the bottom inlet end of the production well tubing. Thus, as the mineral-reactant operation continues, progressively enlarging voids and/or passageways are formed through the ore body, thereby facilitating travel of the reactant and "product" fluids therethrough. While abstracting therefrom the sought-for mineral values the process may operate to "honeycomb" the ore body; or it may operate to disintegrate the ore body, thereby dropping into the lower level of the mining "cavity" the undesired "gangue" minerals in the form of accumulations of residual solids such as are illustrated at 27; depending upon the petrographic nature of the ore body.

Again by way of example, it is to be noted that a mineral of the copper oxide or carbonate type in contact with water-diluted sulphuric acid reacts to produce carbon dioxide gas and the sought-for copper in the form of a soluble copper sulphate. In such case because the copper sulphate is of higher specific gravity than the sulphuric acid solution, the copper sulphate naturally gravitates towards the lower levels of the fragmented ore zone, and thence into the intake of the production well.

In any case, as an in situ mining reaction of the types referred to herein takes place there are typically liberated one or more of a variety of gases, such as for example carbon dioxide, hydrogen sulphide, or the like; depending of course upon the nature of the ore body mineralization. The gases so produced are of enormous volumes and consequently develop high pressures within the mining cavity. Being lighter than the other liquid and solid occupants of the fragmented ore body "cavity", the gases naturally migrate upwardly and tend to accumulate and form a "pad" as illustrated at 28 under the ceiling of the cavity. Heretofore such pads have been typically utilized only to statically shore up and protect the structural integrity of the host rock "roof" of the mining cavity.

However, in the case of a mining operation in accordance with the present invention as illustrated by FIG. 1 for example, the annulus between the outer casing of the well 12 and the inner tube 20 is employed to utilize for energy conservation purposes the on-going accumulation of highly pressurized gas in the upper portion of the fragmented ore body; transmitting the excess thereof under control of the mine operator as shown for example herein through means of a conduit 29, for conversion of the excess pressure energy thereof into useful work by also employing it to "pump" the production well(s) of the system. Conduit 29 couples into a delivery tube as shown at 30 which is made of material chemically inert to the product being pumped, and which extends downwardly inside the production well 14 and is thus immersed in the liquid product which occupies the production well leading to the processing plant 18. At its lower end the tube 30 is perforated as indicated at 32 so as to permit the pressurized gas to jet therefrom and to form gas bubbles in the liquid product, thereby operating to cause the liquid product to rise inside the well casing 14 in accord with the so-called "air lift pump" principle. As illustrated at 42 (FIG. 1) a bleed off conduit under control of an adjustable pressure release valve may be coupled into the conduit 29 to permit escape of excess gas pressure from the system.

Proper control of the "air lift pump" operation relative to the level of the gas pad 28 within the cavity is most important; and is monitored by combining control of the reactant volume input through means of valve 36 and control of the gas pad level in the mine cavity by means of a valve as shown at 38 and pressure gauges 40–41. It is essential that as any underground mining operation progresses with consequent extraction of mechanical support for the roof of "host" rock thereover, the latter must be otherwise supported and maintained against spalling and/or more serious failures such as would close off the mining cavity against travel of fluids therethrough. In accord with the present invention, as the mining process continues the constantly evolving gas pressure is differentially utilized so as to at the same time properly maintain the roof of the mining cavity and to "pump" the liquid products of the operation out of the mine to the processing plant. The control operation comprises monitoring the underground gas pressure (such as by means of the gauges 40–41) and regulating the reactant input rate and gas "pumping" rate such as by means of valves 36, 38. The input rate of, as well as the nature of the chemical reactant; its concentration, etc. will of course be adjusted and constantly regulated according to the various operating parameters as explained hereinabove. It is also to be understood that any chemical values in the gases effluent to the product pumping operation may be recovered through means of the unit 22 and an appropiate ongoing treatment process (not shown) such as are known in the art.

In the drawing herewith the chemical mining and value recovering operation is illustrated at an advanced stage, wherein a substantial portion of the fragmented ore body has already been mined. Note that the casing **12*a* has been drawn upwardly to terminate as shown at 44, and tube 20 has been correspondingly withdrawn; such "withdrawals" being utilized periodically as the mining process continues so as to permit the tubing 20 to discharge in-coming reactant fluid at levels progressively higher in the fragmented ore body to facilitate percolation of the fluid radially thereof and thence downwardly throughout the ore body toward the production well 14. Also, such periodic elevations of the well casing 12*a* facilitate reception by the annulus between the casing and the tubing 20 of evolved gases from all levels of the fragmented ore body, and assists in control of the level of the gas pad 28 in the cavity. Initially however, that is subsequent to drilling of the input well, in order to facilitate the above mentioned "fracturing" and/or explosive fragmenting operations the casing 12*a*** thereof is lowered into the bore hole so that its bottom end comes close to the bottom of the well.

FIG. 2 of the drawing herewith illustrates how the method of the invention may be practiced in conjunction with a single bore hole system. As shown therein, the single bore hole is triple-cased by means of concentric casings 50, 52, 54; the outer casing 50 being initially lowered (upon completion of the well drilling operation) into close proximity with the bottom of the hole. An explosive (with or without a preliminary hydraulic fracturing) operation is then conducted as explained hereinabove, so as to fracture the desired zone of the ore body 10 in directions radially of and primarily upwardly therearound so as to develop a fragmented ore zone 26. The inner casings 52–54 are thereupon lowered inside the casing 50 such as to positions as shown in FIG. 2.

At the "well head" the annulus between the casings 52–54 is coupled in fluid communication with the reactant input conduit 56, and the annulus between the casings 50–52 is coupled in fluid communication with a gas delivery tube 58 which subtends from the well head downwardly inside the casing 54. The tubing 58 is perforated as illustrated at 59. The casing 54 is coupled in fluid communication at its upper end with the degasifier 22 of the product processing plant 18, as explained hereinabove.

Thus, it will be appreciated that, as in the case of FIG. 1, the in situ mining operation may be conducted by controlled input of chemical reactant (liquid or gas, or both) through the annulus between casings 52–54 into the upper level of the fragmented ore zone 26; whereupon the reactant spreads radially outwardly from the bottom end of the casing 52 and thence downwardly through the fragmented ore. As the chemical reaction takes place the sought-for mineral values flow downwardly into the lower levels of the fragmented ore body and through the brecciated "cavity" surrounding the bottom end of the "product" casing 54. Incidental thereto, the gases evolving from the reaction process rise through the brecciated interstices of the upper level of the cavity toward the roof thereof, to initially form a gas pad 28 as explained in connection with FIG. 1 hereinabove; the excess pressure thereof being then diverted through the annulus between casings 50–52 into the gas delivery tube 58. Thus, the gas delivery tube 58 discharges jets of highly pressured gas into the contents of the casing 54 causing them to rise in accordance with the so-called "air lift pump" principle, to be thereby delivered to the degasifier 22 of the surface plant 18, for purposes as explained hereinabove. As described in connection with operation of the system of FIG. 1, the underground gas pressure of the system of FIG. 2 is monitored by reference to gauge 40, and differential control of use of the gas pressure for roof support and "pumping" the production well is provided for by valves 36, 38.

FIGS. 3 and 4 illustrate further embodiment of the invention in which the energy of the evolved pressurized gases is utilized in a slightly different manner to that previously described. In FIG. 3 the pressurized gas withdrawn from the ore cavity 10 is applied by way of gas transport tube 29 to a pneumatic type motor-pump combination 60. This pneumatic type motor-pump unit 60 is operatively connected to the production well 14 so that the energy of the pressurized gas is applied directly to the pumping withdrawal of the liquid products from the mining cavity. Such a pumped withdrawal tends to reduce the pressure at the inlet end of the production well 14 so that the pressure gradient between the injection well 12 and the production well 14 is increased, thereby assisting in the passage of the reactant and product fluids through the permeabilized ore body 10.

FIG. 4 illustrates a modification in which the pressurized gas is applied to assist the injection of the reactant into the ore body 10. Thus, gas transport pipe 64 is connected to a pneumatic type motor-pump unit 62 which in turn is operatively connected to reactant injection tubing 20 in order to assist in the pressurized injection of chemical reactant into the ore body 10. It is readily understood that such assisted pressurized injection of reactant also further increases the pressure gradient between the injection well 12 and the production well 14 which has the result of assisting in the passage of the reactant and product fluids through the permeabilized ore body 10.

Thus, it will be appreciated that in accordance with the present invention the in situ produced and previously unused gas pressures are utilized simultaneously to "maintain" the roof of the mining cavity; to assist in pumping the liquid product up through the production well and thus reduce the effective "back pressure" against travel of the reactant and the liquid product through the chemical mining cavity; and in summary, to conserve a heretofore lost quantum of energy evolving incidental to the chemical mining operation.

What is claimed is:

1. A system for conserving energy incidental to in situ mining a fluid permeable underground cavity confined ore body containing sought-for mineral values, said system comprising:

means for flowing a fluid which is chemically reactive with said mineral values into said ore body to produce a soluble mineral product while evolving pressurized gas incidental to the reaction(s);

means for collecting and raising out of said ore body said mineral product(s) to an upper level processing facility; and means for collecting portions of said evolved gases and utilizing them to assist in raising said mineral product(s) to said upper level.

2. A system as set forth in claim 1, further including means for otherwise utilizing the pressure of said evolved gases.

3. A system as set forth in claim 2, including differential control means for regulating relative utilization of said collected evolved gases vis-a-vis said product(s) raising operation and other usage of said gas pressure.

4. A system as set forth in claim 1, including means for regulating the rate of input of said chemically reactive fluid into said ore body.

5. The method of mining in situ a fluid permeable underground cavity confined body of ore containing sought-for mineral values, said method comprising the steps of:

circulating a fluid which is chemically reactive with said mineral values through said ore body to convert said mineral values into product(s) of liquid form while evolving pressurized gas incidental to the reaction(s); and utilizing said pressurized gas as an energy source to assist in raising said product(s) to an upper level.

6. A method as set forth in claim 5, further including the step of utilizing said pressurized gas to assist in passage of said fluid through said permeabilized ore body.

7. A method as set forth in claim 5, further including the step of maintaining a gas pad of said pressurized gas within said cavity to provide supportive pressure to the walls of said cavity.

8. The method of claim 5 wherein said underground cavity is connected to an upper level by one or more bore holes used as an injection well and a production well, and wherein the step of utilizing said pressurized gas as an energy source to assist in raising said product(s) to an upper level includes the step of injecting a portion of said pressurized gas into said production well thereby assisting in lifting said products to said upper level by the air lift pump principle.

9. The method of claim 5 wherein said underground cavity is connected to an upper level by one or more bore holes used as an injection well and a production well, and wherein said step of utilizing said pressurized gas as an energy source to assist in raising said product(s) to an upper level includes the step of converting the energy of said pressurized gas into a form useful in pumping said product(s) up through said production well.

10. The method of claim 9 wherein said step of converting the energy of said pressurized gas into a different form includes the step of driving a pneumatic type motor coupled to a mechanical pump.

11. The method of claim 7 wherein said step of maintaining a gas pad of pressurized gas within said cavity to provide supportive pressure to the walls of said cavity includes the steps of monitoring the pressure of said gas pad; and utilizing said pressurized gas to assist in raising said product(s) to an upper level only so long as said gas pad is maintained.

12. The method of claim 5 wherein said underground cavity is connected to an upper level by an injection bore hole and a production bore hole, and wherein the step of utilizing said pressurized gas to assist in raising said product(s) to an upper level includes the steps of:

withdrawing at least a portion of said pressurized gas through said injection bore hole; and utilizing said withdrawn gas to assist in raising said product(s).

13. The method of claim 12 wherein said step of utilizing said withdrawn gas to assist in raising said products includes the step of injecting said withdrawn gas into said production bore hole, thereby assisting in lifting said products to said upper level by the air lift pump principle.

14. The method of claim 12 wherein said step of utilizing said withdrawn gas to assist in raising said products includes the step of converting the energy of said pressurized gas into a form useful in pumping said product(s) up through said production bore hole.

15. The method of claim 14 wherein said step of converting the energy of said pressurized gas into a different form includes the step of driving a pneumatic type motor coupled to a mechanical pump.

16. The method of claim 11 wherein the step of maintaining a gas pad further includes the steps of:

withdrawing a portion of said pressurized gas from said gas pad for utilization in assisting in raising said product(s) to an upper level; and in response to said monitored gas pressure of said pressurized gas, differentially regulating said withdrawing step so that said gas pad is not unduly depleted.

17. The method of claim 6 wherein said step of utilizing said pressurized gas to assist in passage of said fluid through said permeabilized ore body includes the steps of:

maintaining a gas pad of pressurized gas at a first position within said cavity; and withdrawing product(s) from a second position within said cavity spaced from said first position thereby creating a pressure gradient between said first and second positions.

18. The method of claim 17 wherein said method further includes the step of injecting said chemically reactive fluid under pressure at a third position within said cavity spaced from said second position in the direction of said first position, thereby increasing said pressure gradient and further assisting in the passage of the fluid through said permeabilized ore body.

19. The method of claim 17 wherein said method further includes the step of withdrawing said product(s) under suction, thereby increasing said pressure gradient and further assisting in the passage of the fluid through said permeabilized ore body.

20. The system as recited in claim 1 wherein said means for collecting portions of said evolved gases and utilizing them to assist in raising said mineral products to said upper level includes means providing fluid communication between said collecting and raising means and said evolved gases for injecting a portion of said gases into said collecting and raising means.

21. The system as recited in claim 1 wherein said fluid flowing means includes an injection well extending between said cavity and the earth's surface and wherein said collecting and raising means is a production well extending between said cavity and the earth's surface, and wherein said evolved gas collecting and utilizing means is a tube extending between said cavity for said production well, and providing fluid communication between said evolved gases and said production well.

22. The system as recited in claim 21 wherein said evolved gas collecting and utilizing means further includes differential control means for regulating relative utilization of said collected evolved gases vis-a-vis said products raising operation and other usage of said gas pressure.

23. The system as recited in claim 21 wherein said tube passes from said cavity up through said injection well and subsequently down through said production well to a level below the earth's surface before making fluid communication with said production well.

24. The system as recited in claim 1 wherein said means for collecting portions of said evolved gases and utilizing them to assist in raising mineral products to said upper level includes a pneumatic type motor coupled to a mechanical pump operatively connected to said collecting and raising means and means connecting said cavity and said motor for delivering portions of said evolved gases to said pneumatic type motor.

25. The system as recited in claim 24 wherein said fluid flowing means includes an injection well extending between said cavity and the earth's surface and wherein said collecting and raising means is a production well extending between said cavity and the earth's surface and wherein said means connecting said cavity and said motor for delivering portions of said evolved gases to said pneumatic type motor includes a tube passing up through said injection well.

26. The system as recited in claim 25 further including differential control means for regulating relative utilization of said collected evolved gases vis-a-vis said product(s) raising operation and other usage of said gas pressure.

27. A system for conserving energy incidental to in situ mining a fluid permeable underground cavity confined ore body containing sought-for mineral values, said system comprising:

means for flowing a fluid which is chemically reactive with said mineral values into said ore body to produce a soluble mineral product while evolving pressurized gas incidental to the reaction(s);

means for collecting and withdrawing out of said ore body said soluble mineral product(s);

means for collecting portions of said evolved pressurized gases; and means for utilizing said evolved pressurized gases to assist in the mining operation.

28. The system as recited in claim 27 wherein said means for utilizing said evolved pressurized gases to assist in the mining operation includes a pneumatic type motor coupled to a mechanical pump operatively connected to said means for flowing said chemically reactive fluid into said ore body and wherein said pressurized gas collecting means is fluidically connected to said pneumatic type motor-pump combination whereby said pneumatic type motor-pump combination is driven by said pressurized gas.

29. The system as recited in claim 28 further including gaseous means within said cavity for providing supportive pressure to the walls of said cavity, said means being a gas pad originating from said evolved pressurized gases.

30. The system as recited in claim 28 further including differential control means for regulating relative utilization of said evolved pressurized gases vis-a-vis pumping said fluid into said ore body and maintaining said gas pad of evolved pressurized gases for cavity wall support.

31. The system as recited in claim 27 wherein said fluid flowing means, said mineral products collecting and withdrawing means, and said gas collecting means all share the same bore hole extending from said ore body to the surface of the earth.

32. The system as recited in claim 31 wherein said fluid flowing means, said mineral products collecting and withdrawing means, and said gas collecting means comprise concentric tubes.

33. The system as recited in claim 31 wherein said means for utilizing said evolved pressurized gases to assist in the mining operation includes means for assisting in withdrawing said soluble mineral products out of said ore body.

34. The system as recited in claim 31 wherein said means for assisting in withdrawing said soluble mineral products out of said ore body includes means providing fluid communication between said pressurized gas collecting means and said soluble mineral products collecting and withdrawing means for injecting a portion of said pressurized gases into said collecting and raising means, whereby said soluble mineral products are assisted in their withdrawal by the air lift pump principle.

35. The method of claim 5 wherein said underground cavity is connected to an upper level by one or more bore holes used as an injection well and a production well, and wherein said step of utilizing said pressurized gas as an energy souce to assist in raising said product(s) to an upper level includes the converting the energy of said pressurized gas into a form useful in pumping said chemically reactive fluid down through said injection well.

* * * * *